US009207629B2

(12) United States Patent
Sakaue et al.

(10) Patent No.: US 9,207,629 B2
(45) Date of Patent: Dec. 8, 2015

(54) IMAGE FORMING APPARATUS HAVING A BIASING MEMBER HAVING A RELEASE STATE AND A LOCKED STATE IN WHICH A DETACHABLE ATTACHABLE UNIT IS SECURED TO AN APPARATUS BODY

(71) Applicants: Yoshinobu Sakaue, Kanagawa (JP); Hiroshi Johno, Kanagawa (JP)

(72) Inventors: Yoshinobu Sakaue, Kanagawa (JP); Hiroshi Johno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/547,571

(22) Filed: Nov. 19, 2014

(65) Prior Publication Data

US 2015/0153705 A1 Jun. 4, 2015

(30) Foreign Application Priority Data

Dec. 2, 2013 (JP) ..... 2013-249500

(51) Int. Cl.
*B41J 15/14* (2006.01)
*B41J 27/00* (2006.01)
*G03G 21/16* (2006.01)

(52) U.S. Cl.
CPC ..... *G03G 21/1647* (2013.01)

(58) Field of Classification Search
USPC ..... 347/242, 245, 257, 263
See application file for complete search history.

(56) References Cited

U.S. PATENT DOCUMENTS 5,848,329 A 12/1998 Aoyama et al.
8,576,265 B2 * 11/2013 Tamaru et al. ..... 347/138
2007/0188589 A1 8/2007 Kusunose et al.
2008/0024851 A1 1/2008 Sakaue et al.
2008/0225304 A1 9/2008 Sakaue et al.
2009/0022520 A1 1/2009 Sakaue et al.
2009/0058981 A1 3/2009 Higaki et al.
2009/0066780 A1 3/2009 Bannai et al.
2011/0199663 A1 8/2011 Johno et al.
2011/0199664 A1 8/2011 Serizawa et al.
2011/0310455 A1 12/2011 Serizawa et al.
2011/0316957 A1 12/2011 Sakaue et al.
2011/0316958 A1 12/2011 Johno et al.
2012/0062685 A1 3/2012 Serizawa et al.
2012/0200655 A1 8/2012 Serizawa et al.
2012/0300007 A1 11/2012 Fujii et al.
2012/0300008 A1 11/2012 Serizawa et al.
2013/0106971 A1 5/2013 Watanabe et al.

FOREIGN PATENT DOCUMENTS

JP 10-078737 3/1998
JP 11-174940 7/1999
JP 2006-150836 6/2006

* cited by examiner

*Primary Examiner* — Hai C Pham
(74) *Attorney, Agent, or Firm* — Oblon, McClelland, Maier & Neustadt, L.L.P.

(57) ABSTRACT

An image forming apparatus includes an apparatus body including positioning faces; a detachably attachable unit including receiving parts and contact parts; and a biasing member to press the receiving parts of the detachably attachable unit to the positioning faces disposed on the apparatus body. The biasing member is rotatably disposed to the apparatus body, contacts the contact parts disposed on the detachably attachable unit, presses the receiving parts against the positioning faces, and is elastically deformable in a direction separating from a rotary supporting point of the biasing member; and when the biasing member is rotated to a locked state from a release state, the biasing member is hooked to the contact parts, so that the receiving parts are pressed toward the positioning faces by the biasing member.

8 Claims, 10 Drawing Sheets

IMAGE FORMING APPARATUS HAVING A BIASING MEMBER HAVING A RELEASE STATE AND A LOCKED STATE IN WHICH A DETACHABLE ATTACHABLE UNIT IS SECURED TO AN APPARATUS BODY

CROSS-REFERENCE TO RELATED APPLICATION

The present application claims priority pursuant to 35 U.S.C. §119(a) from Japanese patent application number 2013-249500, filed on Dec. 2, 2013, the entire disclosure of which is incorporated by reference herein.

BACKGROUND

1. Technical Field

Exemplary embodiments of the present invention relate to an image forming apparatus such as a printer, a facsimile machine, or a copier.

2. Background Art

Conventionally, an image forming apparatus is known in which a latent image carrier is irradiated with light beams corresponding to image data to thus form a latent image on a surface thereof, and the thus-formed latent image is developed to obtain a visible toner image.

In such types of image forming apparatuses, for ease of replacement caused by failure or limited lifetime and for maintenance, parts or components may be provided in the form of detachably attachable units, which may include a process cartridge including a photoconductor and an optical writing device including optical elements. It is critical that units such as an optical writing device are precisely positioned within the body of the apparatus to obtain a high quality image.

An approach has been attempted to accurately position the optical writing device relative to the image forming apparatus by pressing the optical writing device against a positioning part of the apparatus body using a lever. For example, FIG. 14 illustrates an optical writing device 270 as seen from the side; and FIG. 15 is a schematic structure of a lever unit 220 to position an optical writing device 270.

As illustrated in FIG. 14, cylindrical fixed parts 231, 232 as retainer members are disposed near both lateral ends in Y-direction in the figure. The cylindrical fixed part 231 disposed at one end in the Y-direction contacts a V-shaped receiving part 242 as a positioning member disposed on the apparatus body. Further, the cylindrical fixed part 232 disposed at the other end in the Y-direction contacts a Z-direction receiving part 252 as a positioning member disposed on the apparatus body and is positioned in the Z-direction.

As illustrated in FIG. 15, the lever unit 220 includes a lever 221 mounted rotatable about a center of the cylindrical fixed part 232 as a support point of the rotation and a compression spring 222 contacting an opposite end of the rotary support point of the lever 221 and biasing the lever 221. The lever 221 includes a projection 221*a* that contacts a slanted portion 251 of the apparatus body.

The compression spring 222 serving as a biasing member biases an end of the lever 221 toward the Z-direction, so that the projection 221*a* of the lever 221 abuts the slanted portion 251 disposed on the apparatus body. As a result, the optical writing device 270 receives a reaction force from the slanted portion 251 and is pressed toward the Y- and Z-directions. Then, the cylindrical fixed part 231 disposed at one end in the Y-direction as illustrated in FIG. 14 is pressed against the V-shaped receiving part 242, and the cylindrical fixed part 232 at the other end in the Y-direction is pressed against the Z-direction receiving part 252. With this structure, the optical writing device 270 is positioned and secured to the apparatus body. In addition, when the lever 221 rotates against the biasing force of the compression spring 222, the biasing force is released, so that the optical writing device 270 can be taken out of the apparatus body.

SUMMARY

In one embodiment of the disclosure, there is provided an image forming apparatus that includes an apparatus body including positioning faces; a detachably attachable unit configured to be attachable to and detachable from the apparatus body and including receiving parts and contact parts; and a biasing member to press the receiving parts of the detachably attachable unit to the positioning faces disposed on the apparatus body. The biasing member is rotatably disposed to the apparatus body, contacts the contact parts disposed on the detachably attachable unit, presses the receiving parts against the positioning faces, and is elastically deformable in a direction separating from a rotary supporting point of the biasing member. The biasing member is rotated to a release state in which the detachably attachable unit is released from the apparatus body and a locked state in which the detachably attachable unit is secured to the apparatus body. When the biasing member is rotated to the locked state from the release state, the biasing member is hooked to the contact parts, so that the receiving parts are pressed toward the positioning faces by the biasing member.

These and other objects, features, and advantages of the present invention will become apparent upon consideration of the following description of the preferred embodiments of the present invention when taken in conjunction with the accompanying drawings.

DETAILED DESCRIPTION

Figure 1:
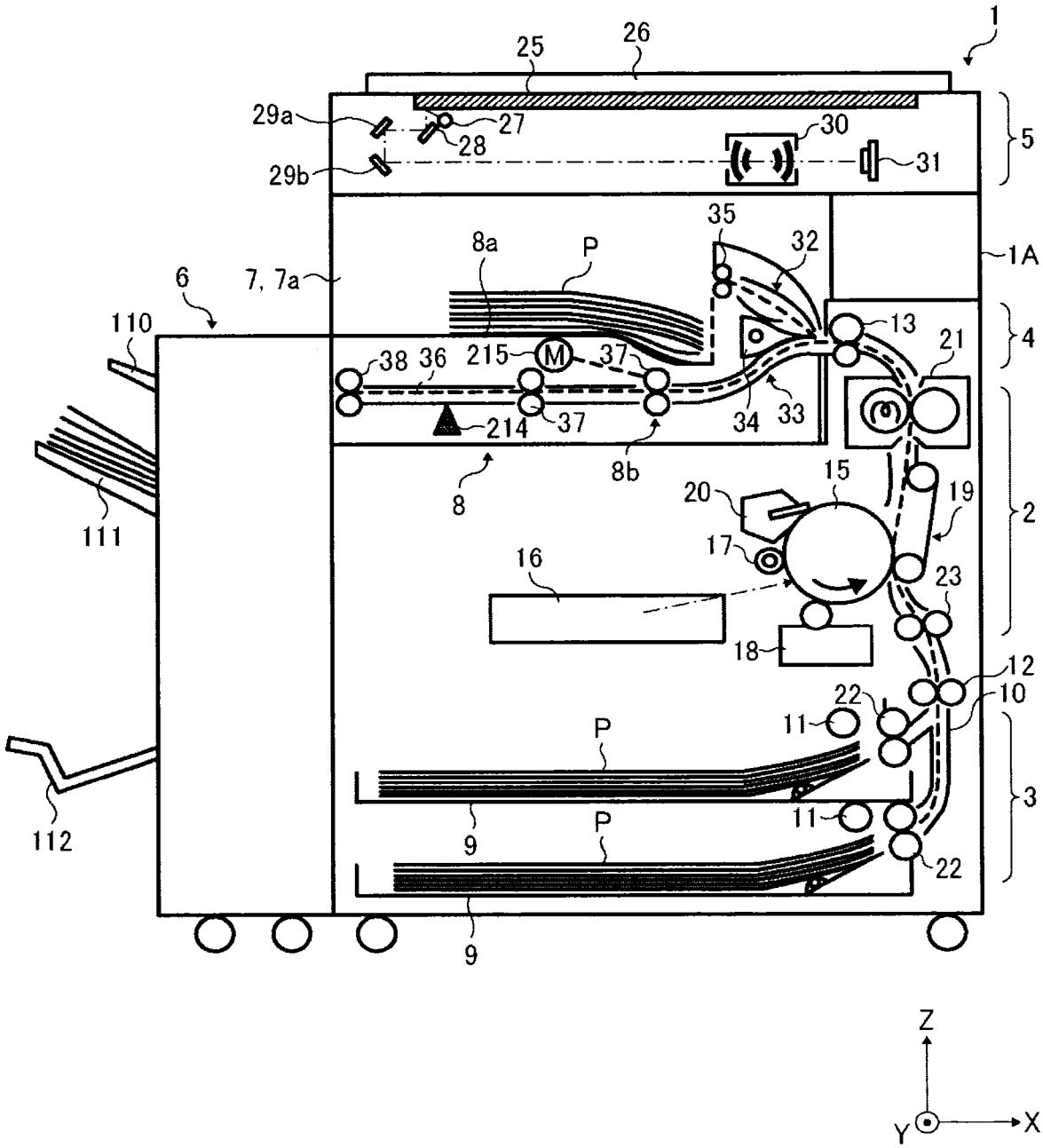
FIG. 1 illustrates a schematic configuration of an image forming apparatus according to an embodiment of the present invention.

Referring to FIG. 1, an image forming apparatus according to an embodiment of the present invention will be described.

FIG. 1 illustrates a schematic configuration of an image forming apparatus 1 according to the present embodiment. The image forming apparatus 1 includes a sheet post-processor 6 as a post-processing device.

As illustrated in FIG. 1, the image forming apparatus 1 includes an apparatus body 1A, an image forming section 2 disposed at a substantial center of the apparatus body 1A, and a sheet supply section 3 disposed below the image forming section 2. Further, the image forming apparatus 1 includes a sheet discharge section 4 disposed above the image forming section 2, and a scanner 5, disposed atop the apparatus body 1A, to read an original image.

The sheet post-processor 6 is disposed on the left side in FIG. 1, which includes at least one of a punch unit, a sorter, a stapler, a binder, and the like.

The image forming apparatus 1 includes an inside discharge section 7 including a sheet discharge space 7*a* disposed below the scanner 5 and on a side surface of the sheet discharge section 4. A conveyance unit 8 is disposed in the inside discharge section 7. The conveyance unit 8 conveys a sheet P, such as a sheet-like recording medium, from the sheet discharge section 4 to the sheet post-processor 6.

The sheet supply section 3 includes two sheet feed trays 9 each detachably attachable to and from the apparatus body 1A and containing different types of recording media sheets P.

The sheet P is conveyed via a sheet feed roller 11 from the sheet feed tray 9 to a conveyance path 10 that extends substantially vertically from the sheet supply section 3 to the sheet discharge section 4, and is conveyed along the conveyance path 10 via a conveyance roller 12. Then, after the image forming section 2 performs image formation and fixation, the sheet discharge roller 13 discharges the sheet P to the conveyance unit 8.

The image forming section 2 includes a photoconductor 15 as a latent image carrier that rotates in the counterclockwise direction as indicated by an arrow in FIG. 1, and an optical writing device 16 that forms an electrostatic latent image. Further, a charger 17, a developing device 18, a transfer device 19, and a cleaning unit 20 are sequentially disposed in the counterclockwise direction around the photoconductor 15. The charger 17 charges the photoconductor 15 uniformly, the developing device 18 adheres toner to an electrostatic latent image formed on the photoconductor 15 to render the image visible. In addition, the transfer device 19 transfers the toner image formed by the developing device 18 to the sheet P that has been conveyed thereto. The cleaning unit 20 is a unit to remove any toner remaining on the photoconductor 15 after a transferring operation, and cleans the surface of the photoconductor 15.

The transfer device 19 transfers the toner image onto the sheet P and the fixing device 21 disposed between the transfer device 19 and the sheet discharge section 4 fixes the toner image on the sheet P with heat and pressure.

The optical writing device 16 exposes a surface of the photoconductor 15 with laser beams and optically writes images thereon based on image data from the scanner 5 or image data input from a personal computer, and forms an electrostatic latent image on a surface of the photoconductor 15.

The sheet P is selectively supplied from any one of the vertically mounted sheet feed trays 9 via any one of the sheet feed rollers 11, and is separated page by page by a separation roller pair 22, and is conveyed along the conveyance path 10 by the conveyance roller 12.

Further, the sheet P is temporarily suspended in its conveyance at a registration roller pair 23 disposed upstream of the transfer device 19 in the sheet conveyance direction. Thereafter, the sheet P is fed between the transfer device 19 and the photoconductor 15 at a predetermined timing and the toner image is transferred from the photoconductor 15 onto the sheet P thereat.

The scanner 5 includes a contact glass 25 on which an original document is placed, a white pressure plate 26 to press the original document from above, and an illumination lamp 27 to irradiate the original document placed on the contact glass 25 with light beams. In addition, the scanner 5 includes a scanning mirror 28 and an optical path folding mirror pair 29*a*, 29*b*. The scanning mirror 28 reflects light reflected from a surface of the original document, and the optical path folding mirror pair 29*a*, 29*b* moves at a speed half the speed of the scanning mirror 28. Further, the scanner 5 includes an imaging lens 30 and a charge coupled device (CCD) 31.

A sheet discharge tray 8*a* is disposed on an upper surface of the conveyance unit 8, which includes a roller conveyance section 8*b* to convey a sheet to be discharged to the sheet post-processor 6. Further, the conveyance unit 8 includes a first conveyance section 32 and a second conveyance section 33, and a bifurcating pawl 34 to switch a forwarding path of the sheet P from the sheet discharge roller 13 to either the first conveyance section 32 or the second conveyance section 33. The first conveyance section 32 serves to convey the sheet P to be discharged from the sheet discharge roller 13 of the sheet discharge section 4 to a sheet discharge tray 8*a*. The second conveyance section 33 serves to convey the sheet P to be discharged from the sheet discharge roller 13, to the roller conveyance section 8*b*.

The first conveyance section 32 includes a sheet discharge roller 35 to discharge the sheet P to the sheet discharge tray 8*a*. The roller conveyance section 8*b* to communicate with the second conveyance section 33 includes a relay conveyance path 36 to communicate with the sheet post-processor 6 inside the conveyance unit 8. The roller conveyance section 8*b* further includes two conveyance rollers 37 disposed on the relay conveyance path 36 and a sheet discharge roller 38 disposed downstream of the relay conveyance path 36 in the sheet conveyance direction and serving as a sheet discharge roller to discharge the sheet P to the sheet post-processor 6.

In addition, the conveyance unit 8 includes a relay sheet discharge sensor 214 to detect a jamming of the sheet being conveyed in the relay conveyance path 36. The two conveyance rollers 37 and the sheet discharge roller 38 are connected to each other via a transmitter of the driving force such as a pulley or a belt, and are driven to rotate by a single relay conveyance motor 215.

Figure 2:
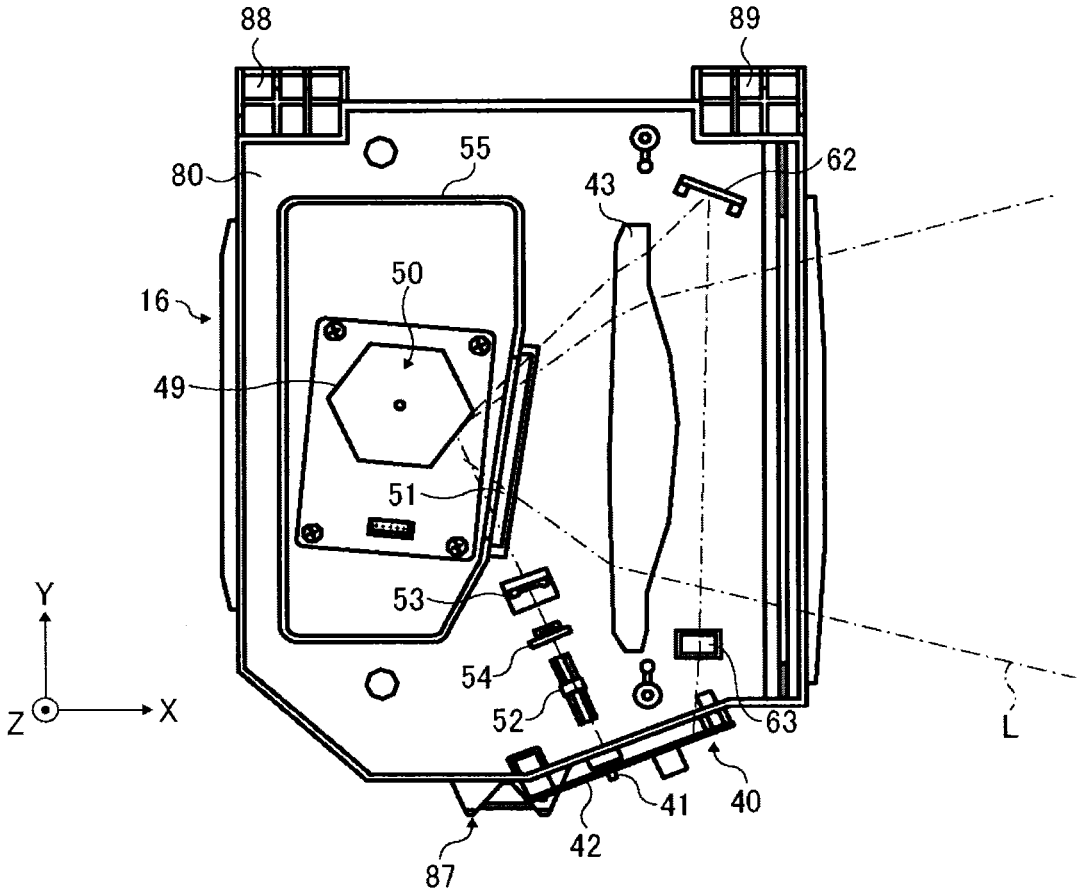
FIG. 2 illustrates a schematic configuration of an optical writing device.

FIG. 2 illustrates a schematic configuration of the optical writing device 16.

The optical writing device 16 includes an LD unit 40, a collimator lens 52, an aperture 54, a cylindrical lens 53, a polygon scanner 50, a scanning lens or an LD lens 43, a synchronization mirror 62, and a synchronization lens 63. These are mounted to an optical housing 80. The optical housing 80 is box-shaped with an open top, and a cover is provided to prevent invasion of dust particles into the optical writing device. The LD unit 40 is disposed on a side wall of the optical housing 80. The optical housing 80 is made of a thermoplastic resin including fiberglass.

The LD unit 40 includes a light source 41 made of semiconductor lasers to scan the photoconductor 15 with light beams L and a control board 42 on which a photo IC is fixed.

The polygon scanner 50 serves as a deflecting member and includes the polygon mirror 49, a rotary multi-faceted mirror with a regular polygonal prism shape. The polygon scanner 50 is fastened to an interior of a soundproof wall 55 of the optical housing 80 with screws. In the present embodiment, the polygon mirror 49 is configured to be a regular hexagonal prism shape and includes six reflective faces, but the configuration thereof is not limited to this.

The light beams emitted from the light source 41 of the LD unit 40 are transformed into parallel light beams by the collimator lens 52. Then, the parallel beams trimmed by an aperture 54 enter the cylindrical lens 53 and focus in the sub-scanning direction, that is, the direction corresponding to the direction of rotation of the photoconductor. Then, the focused beams enter the polygon mirror 49. The light beams L incident to the polygon mirror 49 is deflected toward the main scanning direction, that is, the direction corresponding to the axial direction on the surface of the photoconductor, while being reflected to the reflective mirrors of the polygon mirror 49. Next, the light beams deflected at a constant angular velocity toward the main scanning direction are incident to a scanning lens 43 after passing through soundproof glass plate 51. The light beams are deflected in the main scanning direction at a constant angular velocity by the polygon mirror 49, and the scanning lens 43 transforms a moving velocity of the thus deflected light beams in the deflection direction into a constant velocity. After passing through the scanning lens 43, the light beams are folded back by the synchronization mirror 62 and are focused by the synchronization lens 63, and strike the photo IC of the LD unit 40.

When the photo IC detects the light beams L, a synchronization signal is output. Thus, the synchronized light beams L based on the image data emitted from the light source 41 sequentially pass through the collimator lens 52, the aperture 54, the cylindrical lens 53, the polygon mirror 49, and the scanning lens 43. The light beams L that have passed the scanning lens 43 pass through a dustproof glass plate disposed to cover an opening formed in a side wall of the optical housing 80, and optically scan the surface of the photoconductor 15.

Figure 3:
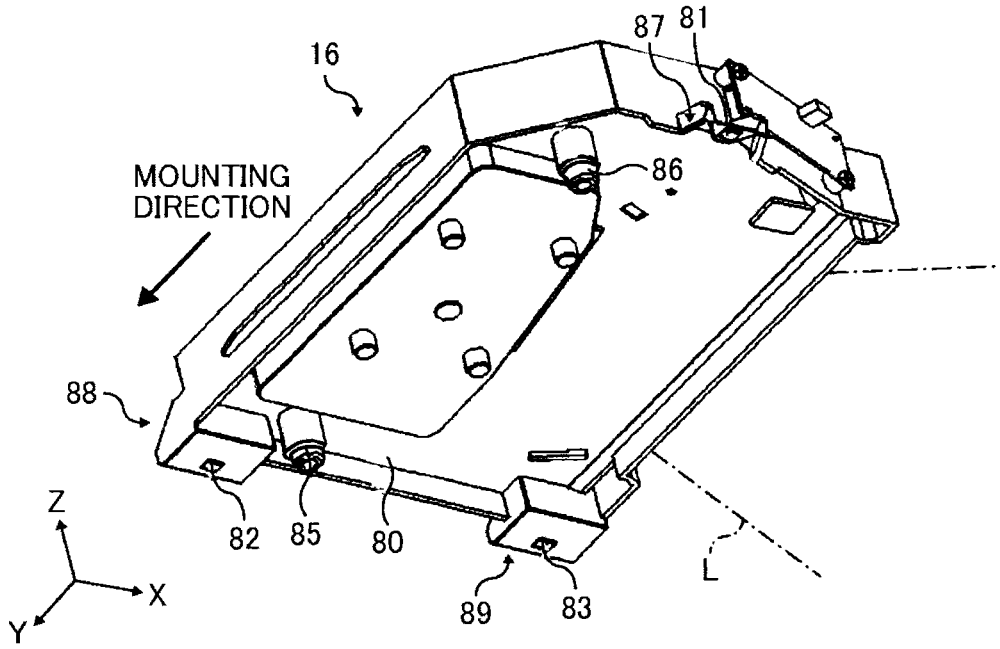
FIG. 3 is a perspective view of the optical writing device seen from the bottom.

FIG. 3 is a perspective view of the optical writing device 16 according to exemplary embodiments of the present invention.

In the following description, a rotary axis direction of the polygon mirror 49 is the Z-axis, a direction from the polygon mirror 49 toward the photoconductor 15 is the X-axis, and the direction perpendicular to the Z-X plane is the Y-axis.

The optical writing device 16 is a detachable unit. As illustrated in FIG. 1, the optical writing device 16 is detachably attached to apparatus body in the Y-axis direction perpendicular to the sheet surface.

As illustrated in FIG. 3, first to third receiving parts 81, 82, and 83 and positioning projections 85, 86 are disposed on a bottom surface of the optical housing 80.

The first receiving part 81 is disposed on a bottom surface of a first fixing part 87, to be described later, disposed in the X-direction center at a proximal end in the attachment direction of the optical writing device 16. The second receiving part 82 is disposed on a bottom surface of a second fixing part 88 disposed at an end in the X-direction at a distal end in the attachment direction of the optical writing device 16, that is, at a side opposite the light beam emitting side of the optical writing device 16. The third receiving part 83 is disposed at a bottom surface of a third fixing part 89 disposed at the other end in the X-direction at a distal end in the attachment direction of the optical writing device 16, that is, at the light beam emitting side of the optical writing device 16. Each receiving part 81, 82, or 83 has a quadratic prism shape slightly exceeding the bottom surface of each fixed part. Top surfaces of the receiving parts each have a high degree of flatness. In addition, each of the receiving parts 81, 82, and 83 has the same height in the Z-axis direction with reference to a predetermined position of the optical writing device.

Figure 4:
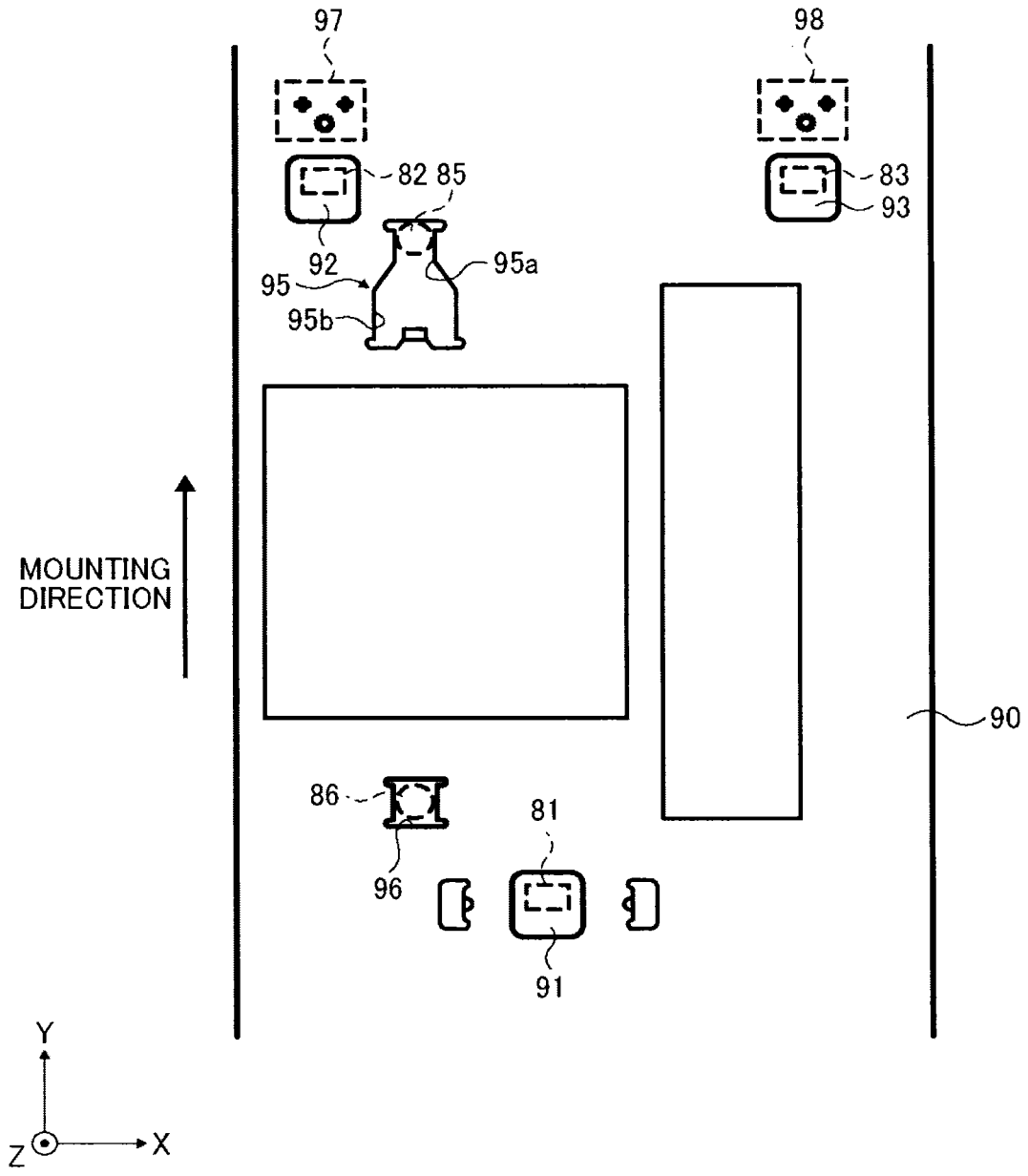
FIG. 4 is a plan view illustrating a stay of an apparatus body to which the optical writing device is secured.

FIG. 4 is a plan view illustrating a stay 90 of the apparatus body to which the optical writing device 16 is secured.

The stay 90 includes first to third positioning faces 91, 92, and 93 and two positioning holes 95, 96. The first positioning face 91 is disposed at a position opposite the first receiving part 81 when the optical writing device 16 is attached to the apparatus body. The second positioning face 92 is disposed at a position opposite the second receiving part 82 when the optical writing device 16 is attached to the apparatus body. Further, the third positioning face 93 is disposed at a position opposite the third receiving part 83 when the optical writing device 16 is attached to the apparatus body. Each of the positioning faces 91, 92, and 93 is disposed with a slight projection from the stay 90, and top surfaces of the positioning faces 91, 92, and 93 each have a high degree of flatness. In addition, each of the positioning faces 91, 92, and 93 has the same height from the stay 90.

The first positioning hole 95 includes a positioning hole **95*a* with which the first projection 85 engages and a guide hole 95*b* which guides the first projection 85 to the positioning hole 95*a*. A length of the positioning hole 95*a* in the X-axis direction is substantially the same as a diameter of a leading end of the first projection 85. The guide hole 95*b* is disposed at a proximal side than the positioning hole 95*a* in the attachment direction of the optical writing device 16. The guide hole 95*b* has a length in the X-axis direction longer than that of the positioning hole 95*a*, so that the length in the X-axis direction of the guide hole 95*b* is reducing as it comes nearer to the first positioning hole 95 at a connection portion with the first positioning hole 95**.

The second positioning hole 96 is a square hole and has a length in the Y-, and X-axis directions which is substantially the same as a diameter of a leading end of the second projection 86.

When the optical writing device is attached to the apparatus body, respective receiving parts 81, 82, and 83 of the optical housing 80 contact corresponding positioning faces 91, 92, and 93 of the stay 90. The heights of each of the receiving parts in the Z-direction and of each of the positioning faces in the Z-direction are adjusted, and a degree of flatness of each contacting portion is high. Accordingly, when the respective receiving parts 81, 82, and 83 contact the corresponding positioning faces 91, 92, and 93, the optical housing 80 is positioned relative to the apparatus body in the Z-axis direction. In addition, when the respective receiving parts 81, 82, and 83 contact the corresponding positioning faces 91, 92, and 93, the optical writing device 16 is positioned relative to the apparatus body in the X- and Y-axis directions.

Further, when mounting of the optical writing device 16 proceeds, the first projection 85 fits in the guide hole **95*b* of the first positioning hole 95. When mounting of the optical writing device 16 further proceeds, the first projection 85 is guided by the guide hole 95*b*, moves to the positioning hole 95, and is secured to the positioning hole 95*a*. As described above, the length of the positioning hole 95*a* in the X-axis direction is substantially the same as the diameter of the first projection 85. Accordingly, when the first projection 85** engages with the positioning hole 95*a*, the optical writing device 16 is positioned to the apparatus body in the X-axis direction.

Further, when the optical writing device 16 is attached to the apparatus body, the second projection 86 fits in the second positioning hole 96. As described above, the length of the second positioning hole 96 in the Y- and X-axis directions is substantially the same as the diameter of the second projection 86. Accordingly, when the second projection 86 engages with the second positioning hole 96, the optical writing device 16 is positioned to the apparatus body in the Y-axis direction. In addition, when each of the projections 85, 86 engages with the positioning holes 95, 96, the optical writing device 16 is positioned to the apparatus body in the Z-axis direction.

As illustrated in FIG. 4, the stay 90 includes a first plate spring mount 97 to which the second fixing part 88 of the optical writing device 16 is attached. Further, the stay 90 includes a second plate spring mount 98 to which the third fixing part 89 is secured to the apparatus body. The first plate spring mount 97 is disposed adjacent to a distal side of the attaching direction of the optical writing device 16 of the second positioning face 92. Further, the second plate spring mount 98 is disposed adjacent to a distal side of the attaching direction of the optical writing device 16 of the third positioning face 93.

Figure 5A:
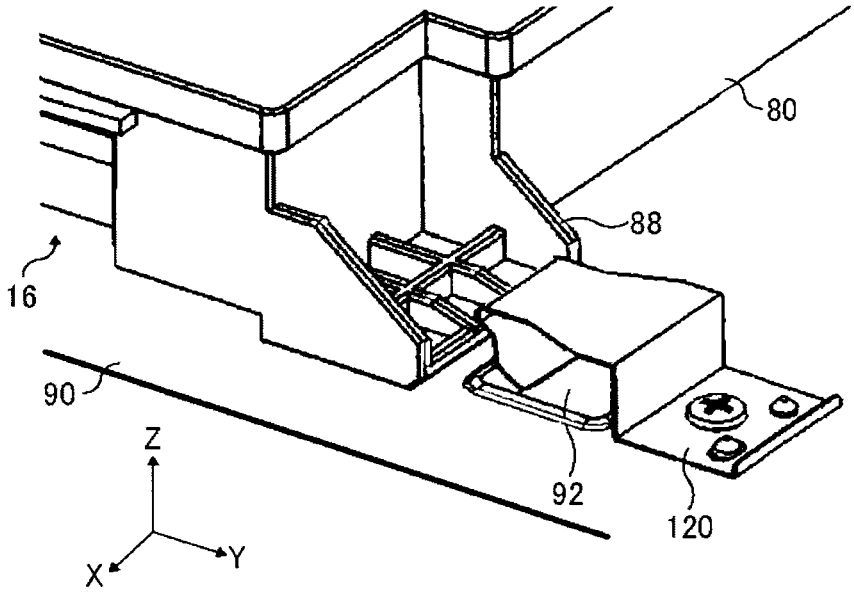
FIGS. 5A and 5B are enlarged perspective views of a second positioning face.
Figure 5B:
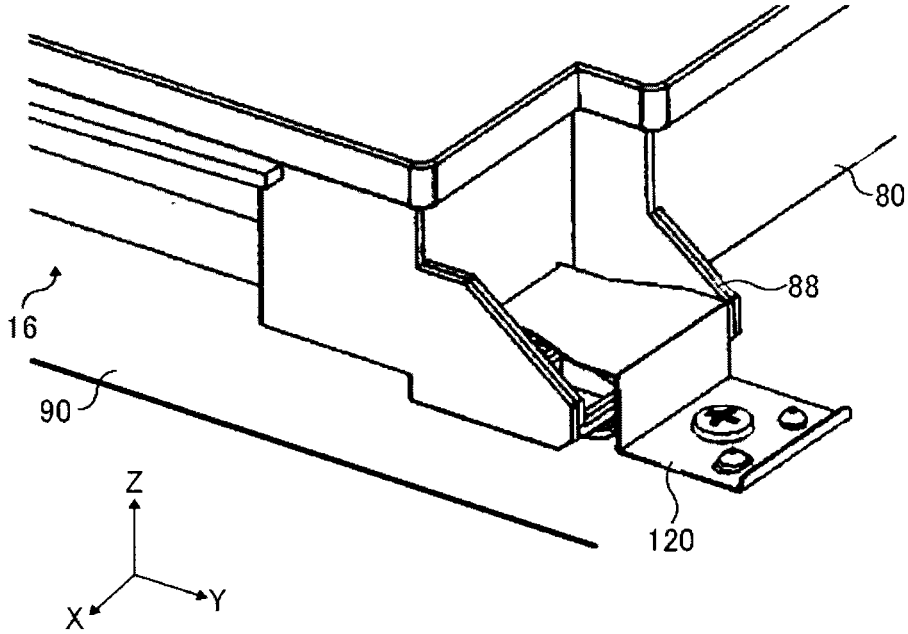

FIGS. 5A and 5B are enlarged perspective views of the second positioning face 92. FIG. 5A shows an interim state in which the optical writing device 16 is being attached to the apparatus body; and FIG. 5B is a view in which the optical writing device 16 has already been attached to the apparatus body.

As illustrated in FIGS. 5A and 5B, a plate spring 120 is attached to the first plate spring mount 97 of the stay 90 in FIG. 4. A leading end of the plate spring 120 is attached to the second positioning face 92.

As illustrated in FIG. 5A, in an interim of attaching the optical writing device 16 to the apparatus body, the second fixing part 88 of the optical housing 80 enters a portion between the plate spring 120 and the second positioning face 92. As a result, as illustrated in FIG. 5B, the second fixing part 88 is pressed toward the second positioning face 92 by the plate spring 120 and is fixed.

Similarly to the second fixing part 88, the third fixing part 89 of the optical housing 80 is pressed toward the third positioning face 93 by the plate spring and is fixed.

Figure 6:
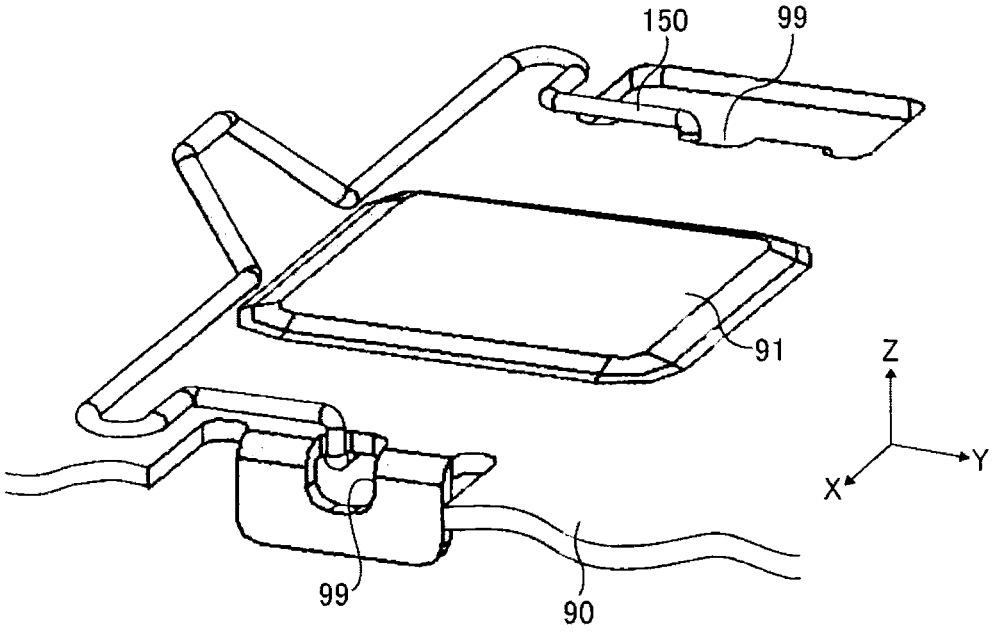
FIG. 6 is an enlarged perspective view of a first positioning face.

FIG. 6 is an enlarged perspective view of the first positioning face 91.

As illustrated in FIG. 6, the stay 90 is provided with a clip 150 that presses, and fixes, the first fixing part 87 of the optical housing 80 (see FIG. 3) toward the first positioning face 91. More specifically, clip attaching holes 99 are disposed at both lateral ends in the X-direction of the first positioning face 91 of the stay 90, and the clip 150 is rotatably attached to these clip attaching holes 99.

Figure 7:
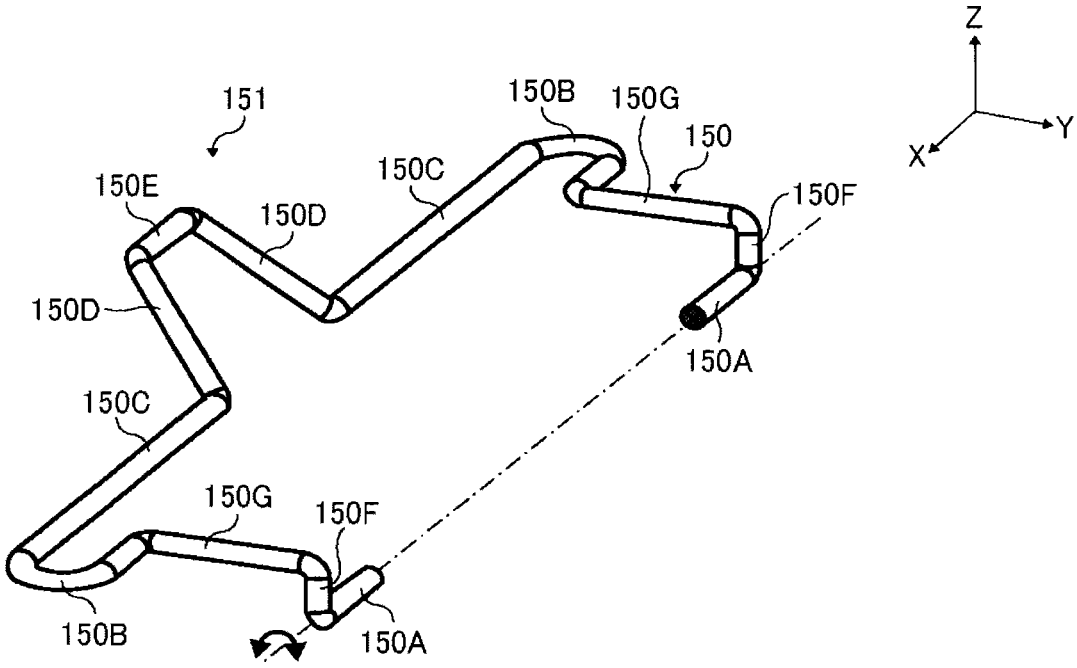
FIG. 7 is a perspective view of a clip.

FIG. 7 is a perspective view of the clip 150.

Figure 8:
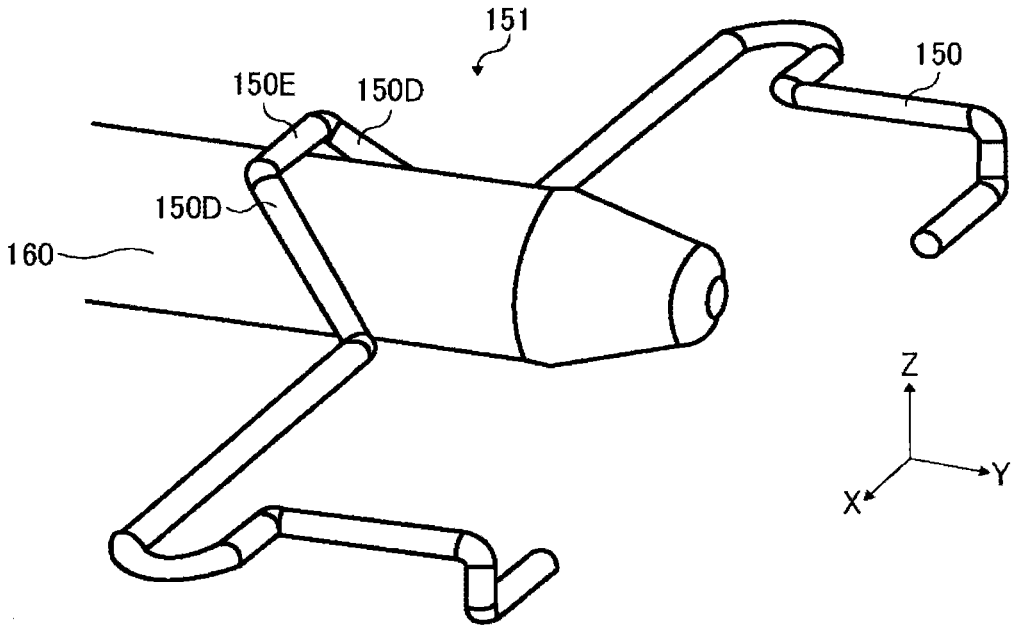
FIG. 8 is a perspective view of the clip including a jig to hook a tool.

The clip 150 is a folded wire made of metal such as iron and includes a pair of mounts 150A that extends in the X-axis direction and is to be attached to the pair of clip attaching holes 99. In addition, the clip 150 includes a pair of rising parts 150F that rises in the Z-axis direction from each of the pair of mounts 150A, and a pair of extension parts 150G that extends in the Y-axis direction from each of the pair of rising parts 150F. Further, the clip 150 includes a pair of elastic adjusters 150B that extends in the X-axis direction outwardly from each of the pair of extension parts 150G, and a pair of pressing parts 150C inwardly in the X-axis direction from each of the pair of elastic adjusters 150B. In addition, the clip 150 includes a jig 151 to hook a tool 160 (see FIG. 8). The jig 151 is disposed at a center in the X-axis direction and connects the pair of pressing parts 150C. The jig 151 includes a pair of slanted parts 150D slanting relative to the Z-axis direction and rising from each end of the pair of pressing parts 150C, and a connecting part 150E connecting each of the pair of slanted parts 150D and extending in the X-axis direction.

The elastic adjusters 150B serve as a design parameter to define a pressing force of the pressing parts 150C toward the first fixing part 87. More specifically, the elastic adjusters 150B each serve as a parameter to define a length of the pressing parts 150C and deformation of the pressing parts 150C when fixed to the first fixing part 87. If the length of the elastic adjusters 150B in the X-axis direction is increased, the length of each of the pressing parts 150C in the X-axis direction increases, so that the pressing parts 150C can be elastically deformed easily. If the length of the elastic adjusters 150B in the Y-axis direction is increased, as described later, each deformed amount of the pressing parts 150C that ride on a fixed face 87B of the first fixing part 87 is reduced, so that the pressing strength of the pressing parts 150C is reduced. Accordingly, the length of the elastic adjuster 150B in the X- and Y-axis directions is determined according to the pressing strength required.

In addition, as illustrated in FIG. 6 previously, a length of each of the pair of rising parts 150F in the Z-axis direction is designed along the stay 90, excluding the size of the jig 151.

By folding back and molding the linear member made of iron, the above-described elastic adjusters 150B and rising parts 150F can be easily formed in the desired shape, to thus construct the clip 150.

The clip 150 is attached to the first fixing part 87 by hooking the tool 160 to the jig 151 and rotating the tool 160 in the X-axis direction. In the present embodiment, the tool 160 is a general-purpose screw driver.

Figure 9:
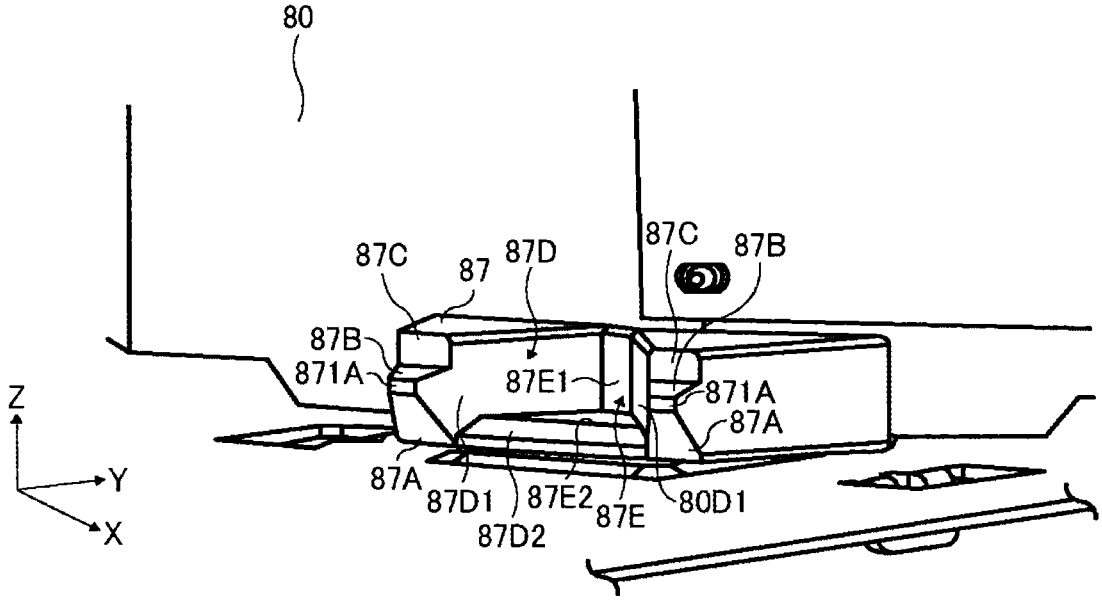
FIG. 9 is a perspective view of a first fixing part of an optical housing illustrating a surrounding portion thereof.

FIG. 9 is a perspective view of the first fixing part 87 of the optical housing 80 illustrating a surrounding portion thereof.

The first fixing part 87 includes a supporting point 87E used for rotating the tool 160. The supporting point 87E positions at a distal side of the first fixing part 87 and is constructed of a vertical face 87E1 parallel to the Z-axis direction and a substantially trapezoidal horizontal face 87E2 parallel to the X-axis direction. In addition, the supporting point 87E includes a guiding part 87D to guide the tool 160 to the supporting point 87E. The guiding part 87D includes a Z-axis direction guiding face 87D2 of which height in the Z-axis direction gradually increases toward the horizontal face 87E2 of the supporting point 87E. The guiding part 87 further includes a pair of X-axis direction guiding parts 87D1 each disposed facing to each other in the X-axis direction and gradually approaching each other toward the vertical face of the supporting point 87E.

In addition, the first fixing part 87 includes a pair of fixed faces 87B that each of the pair of pressing parts 150C of the clip 150 contacts. In addition, the first fixing part 87 includes a pair of contact parts 87C that extends in the Z-axis direction from the distal end in the optical writing device attaching direction of the fixed face 87B of the first fixing part 87, and contacts each of the pressing parts 150C of the clip 150. In addition, as described later, the first fixing part 87 includes a pair of clip guide faces 87A to guide the pair of pressing parts 150C of the clip 150 to the fixed faces 87B.

Figure 10:
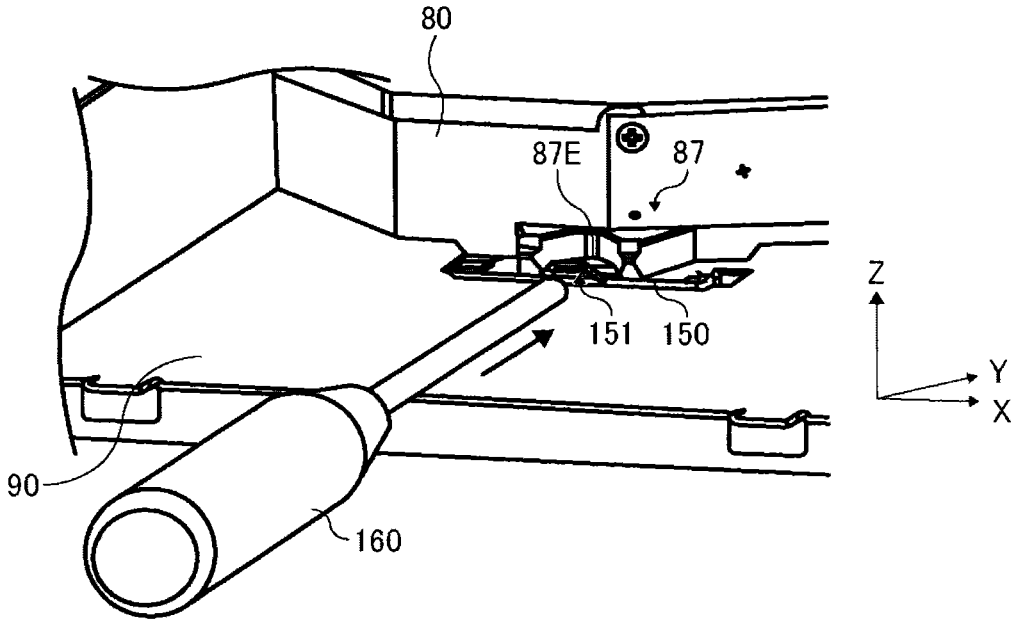
FIG. 10 is a perspective view illustrating a state in which the tool is inserted at a supporting point of the first fixing part.

FIG. 10 is a perspective view illustrating a state in which the tool 160 is inserted at the supporting point 87E of the first fixing part 87.

As illustrated in FIG. 5 previously, when the optical writing device 16 is inserted at the apparatus body until the second and third fixing parts 88, 89 each are fixed via the plate spring 120, the leading end of the tool 160 is passed through the jig 151 of the clip 150 to contact the first supporting point 87E of the first fixing part 87 as illustrated in FIG. 10.

The jig 151 is preferably configured such that a diameter of an inscribed circle formed by the slanted parts 150D, the connecting part 150E forming the jig 151 of the clip 150, and a plane of the stay 90 is 6 mm. Thus, the leading end of the general-purpose screw driver can be passed through between the jig 151 and the stay 90.

As illustrated in FIG. 10, the jig 151 of the clip 150 protrudes from the stay 90. When the optical writing device 16 is attached to the apparatus body, the optical writing device 16 is placed on a rail, not shown, formed by subjecting a squeezing process to the stay 90, and is attached to the apparatus body. The optical writing device 16 slidably moves on the stay 90 along the rail slightly floating from the stay 90. Accordingly, when mounting the optical writing device 16, the optical writing device 16 does not get touch with the jig 151 of the clip 150. The rail is formed by the squeezing process, thereby increasing the strength of the stay 90, which is more preferable than providing a rail member on the stay 90.

Figure 11:
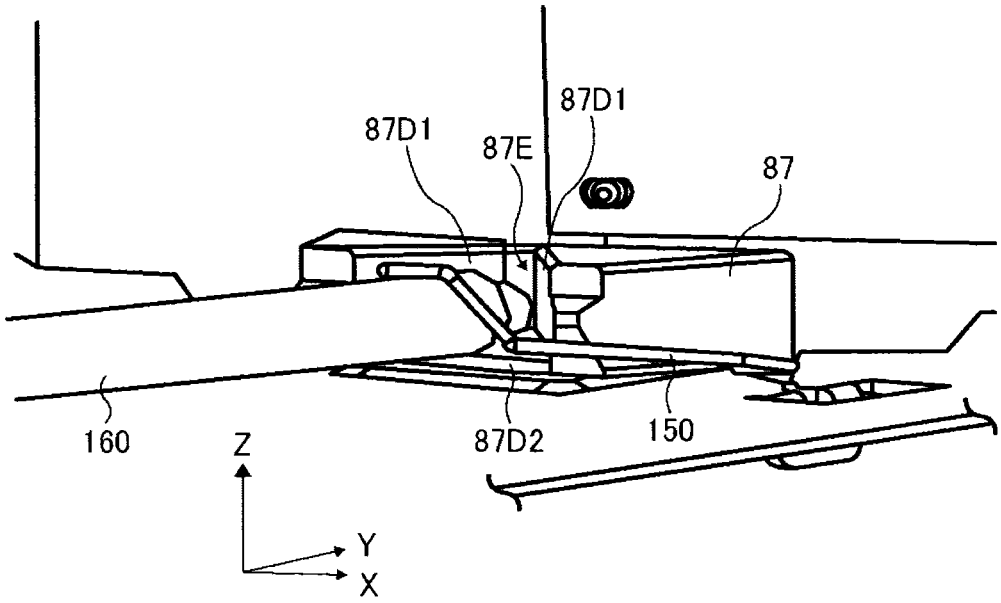
FIG. 11 is a view illustrating a state in which a leading end of the tool is inserted at the supporting point of the first fixing part.

FIG. 11 is a view illustrating a state in which the leading end of the tool 160 is inserted at the supporting point 87E of the first fixing part 87.

After the leading end of the tool 160 is passed through the jig 151, the leading end of the tool 160 is further inserted at contact the supporting point 87E of the first fixing part 87 as illustrated in FIG. 11. At this time, the leading end of the tool 160 is guided by the Z-axis direction guiding face 87D2 and moves to the supporting point 87E. With this structure, the tool 160 smoothly moves to the supporting point 87E without coming into contact with the first fixing part 87. As a result, maintenance of the optical writing device 16 can be performed without difficulty.

In addition, when the tool 160 is moved so that the leading end of the tool 160 contacts the supporting point 87E, even though the tool 160 moves in the Z-axis direction, the X-direction guiding part 87D1 can lead the leading end of the tool 160 to the supporting point 87E. With this structure, the leading end of the tool 160 contacts the supporting point 87E easily, thereby improving workability of maintenance.

Figure 12:
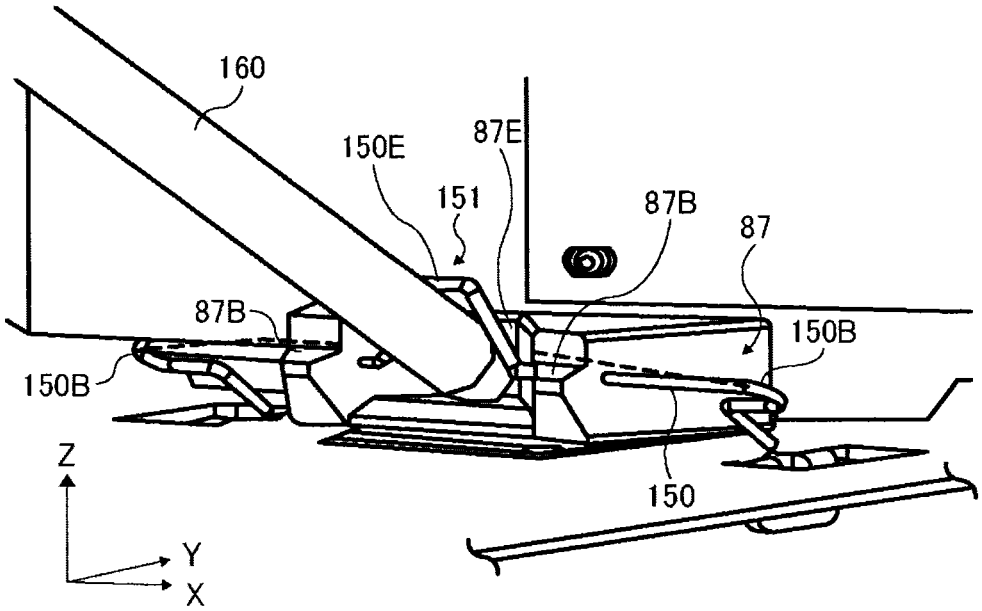
FIG. 12 is a perspective view illustrating a state in which the clip is hooked to the first fixing part using the tool.

FIG. 12 is a perspective view illustrating a state in which the clip 150 is hooked to the first fixing part 87 using the tool 160.

As illustrated in FIG. 12, when the leading end of the tool 160 contacts the supporting point 87E, the tool 160 is rotated about the supporting point 87E in the X-axis direction. Then, the connecting part 150E of the jig 151 is lifted up by the tool 160, so that the clip 150 pivots about the pair of mounts 150A. In addition, the pair of pressing parts 150C elastically deforms as illustrated by a dashed line in FIG. 12. When the tool 160 is further rotated, the pressing parts 150C elastically deforms and the clip 150 is rotated until the pair of pressing parts 150C of the clip 150 rides on the fixed face 87B of the first fixing part 87. With this structure, the pressing parts 150C of the clip 150 presses the fixed face 87B and thus, the clip 150 is fixed.

When the leading end of the tool 160 contacts the supporting point 87E and is rotated, movement of the tool 160 is restricted by the slanted parts 150D of the jig 151 of the clip 150 and the pair of Z-axis direction guiding faces 87D2. With this structure, the tool 160 can be easily rotated about the supporting point 87E, thereby improving the workability.

Figure 13:
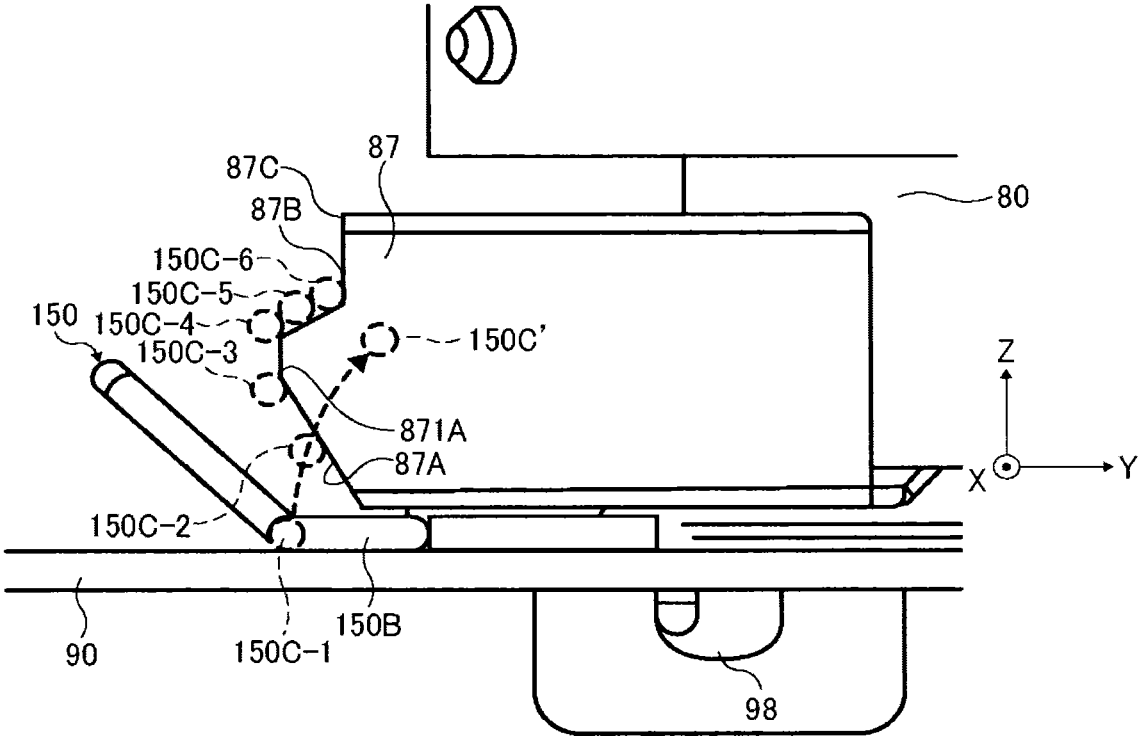
FIG. 13 is a view explaining a trajectory of a pressing part when the first fixing part is fixed by the clip.
Figure 14:
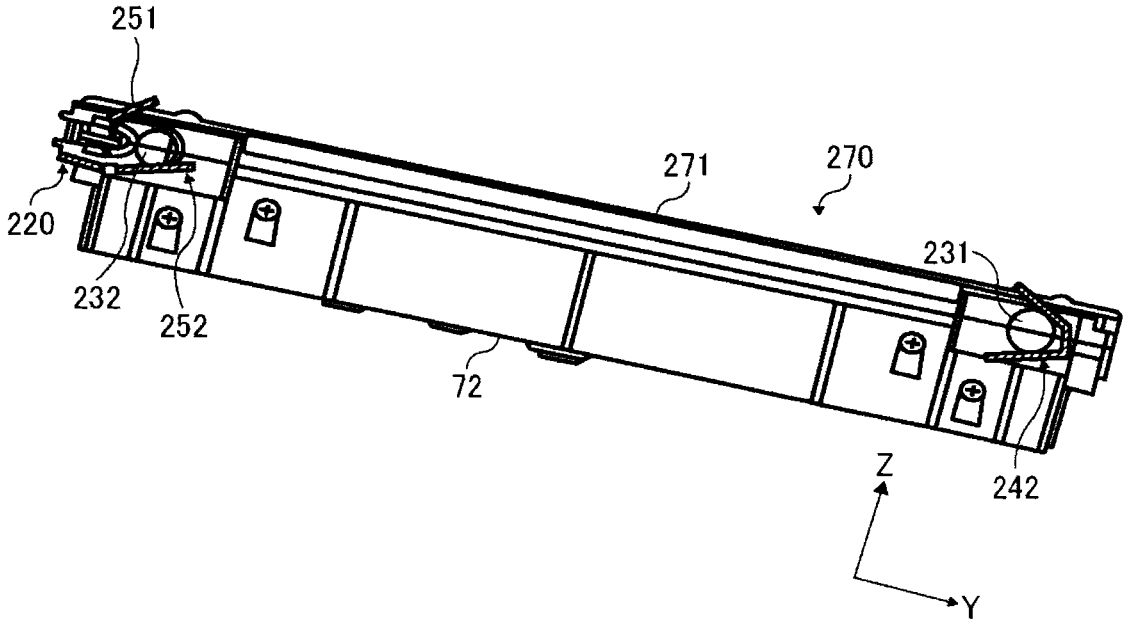
FIG. 14 BACKGROUND ART
FIG. 14 illustrates a conventional optical writing device seen from a side.
Figure 15:
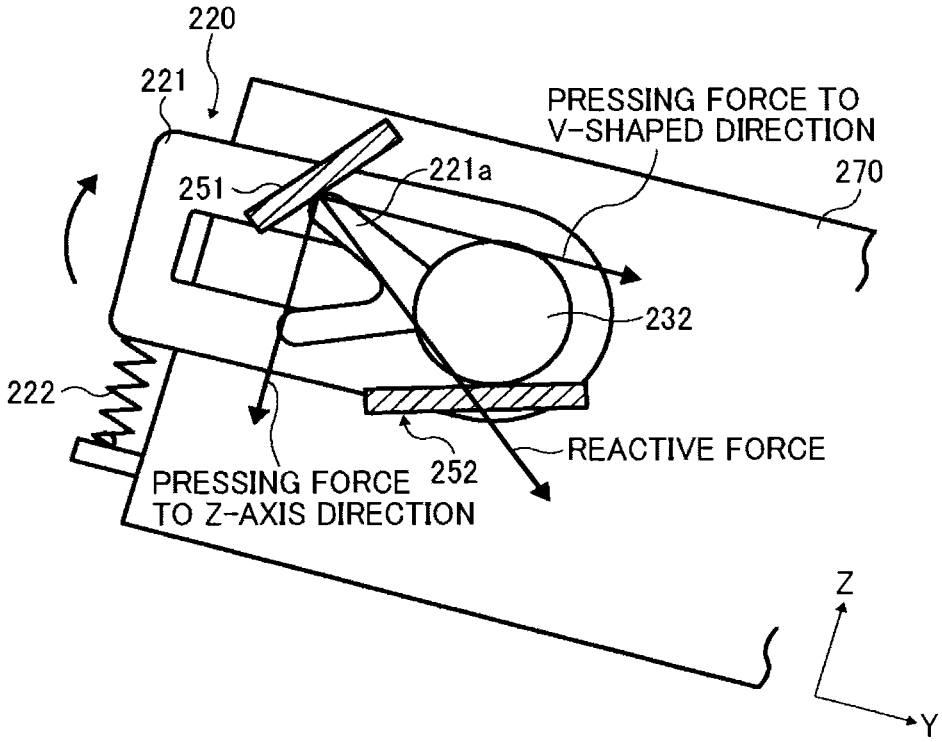
FIG. 15 BACKGROUND ART
FIG. 15 is a schematic structure of a lever unit to position the conventional optical writing device.

FIG. 13 is a view explaining a trajectory of the pressing part 150C when the first fixing part 87 is fixed by the clip 150.

As illustrated in FIG. 13, when the first fixing part 87 is observed from the X-axis direction, the pair of clip guide faces 87A of the first fixing part 87 is formed to cross the trajectory of the pressing parts 150C. Accordingly, when the clip 150 is rotated by the tool 160 from a release position in a state in which the pair of pressing parts 150C is present at a position 150C-1, the pair of pressing parts 150C contacts the pair of clip guide faces 87A of the first fixing part 87, that is, a position of 150C-2 in FIG. 13. From this state, when the tool 160 is rotated in the X-axis direction, the pair of pressing parts 150C elastically deforms in a direction separating from the rotary supporting point (that is, the pair of mounts 150A) and moves along the clip guide faces 87A of the first fixing part 87 (that is, 150C-3 in FIG. 13). When each pressing part 150C reaches a top portion 871A of the clip guide face 87A (150C-4), the clip 150 rotates by the pressing parts 150C and rides on the fixed faces 87B (see 150C-5 in FIG. 13). Further, by the pressing parts 150C, the clip 150 rotates and the pressing parts 150C contact the contact parts 87C, respectively, thereby preventing the clip 150 from rotatably moving. With this structure, the clip 150 is hooked to the first fixing part 87, so that the first receiving part 81 positions at a pressing position in which the first receiving part 81 is pressed to the first positioning face 91, in which the pressing parts 150C reside at 150C-6. The position of the pressing parts 150C when the clip 150 is rotated without elastically deforming the pressing parts 150C is at 150C' in FIG. 13. Accordingly, the first fixing part 87 is pressed toward the stay 90 and the attachment direction of the optical writing device by the pressing parts 150C of the clip 150, and is fixed.

The first fixing part 87 is pressed toward the stay 90 by the pressing parts 150C of the clip 150, so that the first receiving part 81 is pressed toward the first positioning face 91 and is fixed. Further, the first fixing part 87 is pressed toward the attachment direction of the optical writing device by the pressing parts 150C of the clip 150, so that the second projection 86 can be contacted an edge of the second positioning hole 96 in the attachment direction of the optical writing device. With this structure, the second projection 86 of the optical writing device 16 can be sandwiched by the second positioning hole 96 and the clip 150, thereby preventing the optical writing device 16 from vibrating in the Y-axis direction in the apparatus body and securing the fixation thereof relative to the apparatus body.

In addition, as illustrated in FIG. 13, a pressing angle θ of the pressing parts 150C relative to the Y-axis direction is preferably set to 45+/−35 degrees when the pressing parts 150C contact the contact parts 87C and the optical writing device 16 is fixed by the clip 150. With this structure, the pressing parts 150C can press in the two-axis directions with a small angle of rotation and the rotation angle of the tool 160 can be small. With this structure, even though the optical writing device is disposed distally in the apparatus and allowance of the rotation angle of the tool 160 is small, the clip 150 can be rotated by the tool 160, and the pressing parts 150C can ride on the fixed face 87B.

When the first fixing part 87 is observed from the X-axis direction, the clip guide face 87A of the first fixing part 87 is formed to cross the trajectory of the pressing part 150C. Then, when the clip 150 is rotated by the tool 160, the pressing parts 150C can contact the pair of clip guide faces 87A. With this structure, when the clip 150 is further rotated by the tool 160, the jig 151 is lifted up by the tool 160, so that the pressing parts 150C can be elastically deformed. With this structure, when the clip 150 is further rotated by the tool 160, the pressing parts 150C can be elastically deformed.

To release fixation by the clip 150, a service person pulls the connecting part 150E of the jig 151 to the front to rotate the clip 150 from the pressed position to the release position easily. If the connecting part 150E is designed to be high, the release power can be reduced.

Thus, in the present embodiment, when the optical writing device 16 is taken out from the apparatus body, the clip 150 can be positioned at a release position, thereby enabling to take out the optical writing device 16 from the apparatus body easily.

In addition, in the present embodiment, when the clip 150 is positioned at the release position, the clip 150 does not receive any force to rotate to the pressed position. With this structure, when the optical writing device 16 is attached to or detached from the apparatus body, the clip 150 need not be pressed to the release position. As a result, the optical writing device 16 can be easily attached to or detached from the apparatus body.

In addition, in the present embodiment, a general-purpose screw driver can be used as a tool to rotate the clip 150 and securely position the optical writing device 16. Because there is no need of using a special tool for rotating the clip 150, the following merit can be obtained. Specifically, when the service person performs maintenance work of optical writing device 16, there is no need of providing the special tool for rotating the clip 150. Accordingly, for example, even though the service person forgets to bring any special tool for the maintenance, he or she does not need to return to the service center to pick up the special tool. In addition, after having fixed the optical writing device by the clip 150, the service person handles other maintenance works such as screwing the cover to the apparatus, and thus, the workability is improved.

In addition, in the present embodiment, the supporting point when the clip 150 is rotated is disposed on the first fixing part 87 of the optical housing 80. In the present embodiment, as illustrated in FIG. 13, when the tool 160 is rotated, while the pressing parts 150C of the clip 150 being pressed against the pair of clip guide faces 87A, the pressing parts 150C is elastically deformed. When the supporting point of the tool 160 is positioned at the stay 90, for example, and is not positioned at the optical housing 80, the following failure will occur. Specifically, when the clip 150 is rotated while the pressing parts 150C being deformed elastically, the optical housing 80 may float due to a friction force between the pressing parts 150C and the pair of clip guide faces 87A.

By contrast, when the supporting point when the clip 150 is rotated is disposed on the first fixing part 87 of the optical housing 80, the following effects can be obtained. Specifically, when the clip 150 is rotated while the pressing parts 150C of the clip 150 being deformed elastically, the pressing force of the pressing parts 150C is applied to the first fixing part 87 via the tool 160. With this structure, when the clip 150 is further rotated by the tool 160, the first fixing part 87 can be pressed toward the stay 90. As a result, the optical housing 80 does not float from the stay 90, the pressing parts 150C can be elastically deformed, and the pressing parts 150C can ride on the fixed face 87B easily.

In addition, the clip 150 can be disposed on the optical housing 80, and the first fixing part 87 can be disposed on the stay 90 of the apparatus body. However, the clip 150 may preferably be disposed on the stay 90. This is because, when the clip 150 is disposed on the optical housing, each optical writing device as being a replacement device needs a clip 150, resulting in a cost rise. However, if the clip 150 is disposed on the stay 90, even though the optical writing device 16 is replaced, the clip 150 remains in the apparatus body. As a result, there is no need of providing a clip for each optical writing device, thereby preventing the cost rise of the apparatus.

In addition, in the present embodiment, the optical writing device 16 is pressed by the plate spring 120 and the clip 150 toward the positioning faces 91, 92, and 93 and is secured to the apparatus body. As a result, compared to a case in which the optical writing device 16 is secured to the apparatus body by screwing, the following advantage can be obtained. Specifically, when the optical writing device 16 is secured to the apparatus body by screwing, when fastening by screws, force toward the rotation direction of the screws is applied to the optical writing device 16, so that the optical writing device 16 may rotate in the rotation direction of the screws. Even a slight deviation from the predetermined position or posture of the optical writing device 16 may affect the formed image. As a result, precision in the position and posture of the optical writing device 16 relative to the apparatus body should be accurate. When the optical writing device 16 rotates in the rotation direction of the screws, relative position or posture of the optical writing device 16 change and a high quality image is not obtained. Further, when securing with screws, the fastening force of the screws changes from point to point, and residual stress may remain in the optical writing device 16 after screwing, resulting in probability of bending and twisting. Further, in the mass-production process, multiple screws need be screwed one by one, which results in a long assembly time period and a production cost increase.

By contrast, in the present embodiment, fixation of the optical writing device in the distal side is performed with two plate springs 120 disposed opposite the positioning faces 92 and 93. With this structure, only by inserting each of the fixing parts 88 and 89 of the optical housing between the plate springs 120 and the positioning faces 92 and 93, respectively, the distal side of the optical writing device 16 in the attachment direction can be secured. In this case, the insertion direction of each of the fixing parts 88 and 89 of the optical housing between the plate springs 120 and the positioning faces 92 and 93 is the same as the insertion direction of the optical writing device 16 to the apparatus body. As a result, by attaching the optical writing device 16 to the apparatus body, each fixing part 88 or 89 of the optical housing can be inserted between the plate springs 120 and the positioning faces 92 and 93, respectively, so that the distal side of the optical writing device 16 in the attachment direction can be secured. As a result, compared to the case in which the optical writing device 16 is secured to the apparatus body by screwing, the optical writing device 16 can be secured to the apparatus body, thereby reducing the production time period and preventing the increase in the production cost.

In addition, each fixing part 88 or 89 is inserted between the plate spring 120 and the positioning face 92 or 93, each fixing part 88 or 89 is pressed toward the positioning face 92 or 93. With this structure, differently from fastening with screws, any force to deviate the position or posture of the optical writing device 16 is not applied to the optical writing device 16. Accordingly, differently from fastening with screws, deviations in the position and posture of the optical writing device 16 can be prevented, thereby obtaining a high quality image.

Fixation of the proximal side of the optical writing device 16 in the attachment direction can be performed by rotating the clip 150 with the tool 160. With this structure, compared to a case in which the optical writing device 16 is secured to the apparatus body by screwing, the optical writing device 16 can be secured to the apparatus body easily. In addition, in the present embodiment, the supporting point is disposed on the first fixing part 87 of the optical housing 80. With this structure, in a state in which the first fixing part 87 is pressed to the first positioning face 91 using the tool 160, the optical writing device 16 can be secured to the apparatus body by the clip 150. With this structure, differently from fastening with screws, any force to deviate the position or posture of the optical writing device 16 is not applied to the optical writing device 16 when securing it to the apparatus body. Accordingly, differently from fastening with screws, deviations in the position and posture of the optical writing device 16 can be prevented, thereby obtaining a high quality image.

In addition, the optical housing 80 including the receiving parts 81, 82, and 83 is made of resins, and the stay 90 including the positioning faces 91, 92, and 93 is made of metal. As a result, linear expansion coefficients of the above two materials are different from each other. As a result, when fastening the optical writing device with screws, tensile force is generated between two members with different materials of the optical housing 80 and the stay 90 when the temperature rises, which may cause a deformation of the optical housing 80. As a result, a position and posture of the optical elements of the optical writing device 16 included in the optical housing may change, thereby causing to change optical features of the photoconductor. On the other hand, in the present embodiment, the optical writing device 16 is pressed by the plate springs 120 and the clip 150 toward the positioning faces 91, 92, and 93 and is secured to the apparatus body. Accordingly, even though the linear expansion coefficients of the optical housing 80 and that of the stay 90 are different, the tensile force is not generated between the optical housing 80 and the stay 90 because the plate spring 120 and the pressing parts 150C of the clip 150 elastically deform. Thus, any deformation in shape of the optical housing 80 can be prevented from occurring, and the change in the optical features of the photoconductor can be prevented.

In addition, when the optical writing device 16 is secured to the apparatus body by screws, any shock applied to the apparatus body is directly applied to the optical writing device 16. By contrast, in the present embodiment, because the optical writing device 16 is secured by being pressed by the plate springs 120 and the clip 150, elasticity is generated between the apparatus body and the optical writing device 16. As a result, even when a shock is applied to the apparatus body, the plate springs 120 and the clip 150 elastically deform to moderate the impact. With this effect, any shock to the optical writing device 16 can be moderated.

Further, in the present embodiment, the first fixing part 87 including the first receiving part 81 is disposed in the X-axis direction center at the proximal end in the attachment direction of the optical writing device 16. Further, the second fixing part 88 including the second receiving part 82 is disposed at a distal end in the X-axis direction in the attachment direction of the optical writing device 16, and the third fixing part 89 including the third receiving part 83 is disposed at the other distal end. As described above, in the present embodiment, the optical writing device 16 is securely positioned at three points in the Z-axis direction. With this structure, because there are three points to exert positional accuracy in the Z-axis direction, the apparatus can be provided inexpensively compared to a case in which the optical writing device is positioned with four points. In the structure to position the apparatus using four points with respect to the Z-axis direction, if any one of the four points is deviated in the Z-axis direction, the optical housing 80 may be twisted and deformed. On the other hand, in the present embodiment, even when the first receiving part 81 and the first positioning face 91 are positionally deviated, the optical writing device 16 may only slant with respect to the Y-axis direction with the two positioning points in the distal side in the attachment direction of the optical writing device 16 set as supporting points. Accordingly, compared to the case in which the optical writing device is positioned with four points, twisting and deforming of the optical housing can be prevented more effectively.

Further, in the present embodiment, there is provided one receiving point at the proximal side in the attachment direction of the optical writing device 16, and two receiving points, that is, the second receiving part 82 and the third receiving part 83 are disposed in the distal side. When the apparatus body includes two side plates opposing to the Y-axis direction and the frame connecting these two side plates and extending in parallel to the Y-axis, an opening to detachably attach the optical writing device is disposed on the side plate in the proximal side in the attachment direction of the optical writing device. On the other hand, the side plate of the optical writing device in the distal side in the attachment direction of the optical writing device has a less number of openings. When the installation surface of the image forming apparatus is not horizontal, the distal side where the side plate has a less number of openings rarely deforms according to the installation surface. Accordingly, the stay 90 in the distal side of the apparatus moves less in the Z-axis direction than in the proximal side of the apparatus. Accordingly, if the two receiving parts of the optical writing device are disposed in the distal side of the apparatus, a positional error in the Z-axis direction between the distal side receiving part and the proximal side receiving part can be prevented more effectively, and the twisting of the optical housing can be prevented. In addition, because one receiving part in the proximal side of the apparatus can be disposed in the center in the X-axis direction, adverse effects of the positional error of the side plate in the proximal side can be made smaller than in the edge portion in the Z-axis direction. As a result, the positional error in the Z-axis direction due to the deformation of the side plate can be minimized.

In addition, among two side plates, the side plate to which a driving part to drive the photoconductor is attached is strengthened by the driving part, so that the deformation does not easily occur. Accordingly, the side plate to which the driving part is attached may be employed for providing the two receiving parts.

Further, in the present embodiment, as illustrated in FIG. 7 previously, the clip 150 is symmetrically formed relative to the symmetrical axis parallel to the Y-axis direction that passes through the center of the X-axis direction. In addition, the pair of fixed faces 87B of the first fixing part 87 pressed by the pair of pressing parts 150C of the clip 150 are symmetrically formed relative to the above symmetrical axis. Thus, the pressing force applied to each of the fixed faces 87B can be the same, so that the twisting of the optical housing 80 can be prevented.

In addition, because the first receiving part 81 is disposed at the symmetrical axis, the pressing force of each of the pressing parts 150C can be evenly added, the first receiving part 81 can be pressed toward the first positioning face 91 evenly.

In addition, in the present embodiment, although the clip 150 is rotated from the release position to the pressed position using the tool 160, the clip 150 can be pulled up by the service person with fingers and the pressing parts 150C can be hooked on the fixed face 87B.

The present invention may be applied to any detachably attachable unit such as a process cartridge that is positioned relative to the apparatus body. Herein, the process cartridge means a unit including the photoconductor 15 and any one of the charger 17, the developing device 18, and the cleaning unit 20 in combination, which is configured to be detachably attachable to the image forming apparatus.

In the present embodiment, an example in which the present invention is applied to the optical writing device for the monochrome image formation has been described; however, the present embodiment can be applied to an optical writing device employing an opposite scanning method capable of optically writing a plurality of photoconductors. The optical writing device of the opposite scanning method is configured such that a pair of optical elements such as scanning lenses, and the like, are symmetrically disposed relative to a symmetric line that passes the rotary center of the polygon mirror and is perpendicular to the rotary axis direction of the polygon scanner.

The aforementioned embodiments are examples and specific effects can be obtained for each of the following aspects:

<Aspect 1>

An image forming apparatus 1 includes a detachably attachable unit such as an optical writing device 16 that is configured to be attachable to and detachable from the apparatus body 1A; and a pressing means to press the receiving parts 81, 82, and 83 of the detachably attachable unit to the positioning faces 91, 92, and 93 disposed on the apparatus body 1A. The pressing means includes a biasing member rotatably disposed to the apparatus body 1A such as the clip 150 that contacts the fixed faces 87B and presses the receiving parts 81, 82, and 83 against the positioning faces 91, 92, and 93, the biasing member elastically deforms in a direction separating from the rotary supporting point of the biasing member According to Aspect 1, as described with reference to FIG. 13, each of the pressing parts 150C of the clip 150 is elastically deformed in a process in which the biasing member such as the clip 150 is rotated from the release state (in which the pair of pressing parts 150C of the clip 150 is disposed at 150C-1 in FIG. 13) to the locked state (in which the pair of pressing parts 150C of the clip 150 is disposed at 150C-6 in FIG. 13), and the biasing member (the pressing parts 150C of the clip 150 in the present embodiment) is hooked to the contact part such as the fixed faces 87B of the first fixing part 87 disposed in the detachably attachable unit such as the optical writing device 16. When the pressing part is hooked to the contact part such as the fixed faces 87B, the first receiving part 81 is pressed toward the positioning part such as the first positioning face 91 due to the resilience force of the biasing member. (In the present embodiment, the resilience force of the biasing member works in the Y- and X-axis directions.) With this, the biasing member and the contact part press the positioning member against the positioned member. With this structure, compared to the structure using a compression spring, a lever, and a contact part to press the receiving part of the detachably attachable unit against the positioning part of the apparatus body, the number of parts and components can be reduced, thereby decreasing the cost of the apparatus.

To remove the detachably attachable unit from the apparatus body, the biasing member is rotated to a release state. With this structure, when the detachably attachable unit is removed from the apparatus body, the resilience force of the biasing member does not adversely affect the removal of the unit and the unit can be smoothly removed from the apparatus body. When attaching the detachably attachable unit, the biasing member is positioned at the release position (in which the pair of pressing parts 150C of the clip 150 is positioned at 150C-1 in FIG. 13). As a result, in the process of attachment, increase of the resilience force due to the press strength from the biasing member can be prevented.

In addition, according to the aspect 1, by hooking the biasing member to the contact part, the pressing force can be maintained, and is different from a structure in which the compression spring maintains the locked state. Accordingly, differently from the background art, a rotational force to rotate the biasing member does not occur to maintain the locked state when the biasing member is removed from the contact part and the press strength is released. Accordingly, there is no need of holding the biasing member not to rotate when the detachably attachable unit is removed from the apparatus body. With this structure, because, when the detachably attachable unit is removed from the apparatus body, there is no need of holding the biasing member while retaining the release state, the removal of the detachably attachable unit from the apparatus body can be smoothly done. Further, there is no need of holding the biasing member not to rotate when the detachably attachable unit is attached to the apparatus body, so that the attachment thereof can be easily done.

Thus, according to the aspect 1, compared to the background art, the attachment and detachment of the unit can be easily performed.

In addition, according to the aspect 1, the biasing member such as the clip 150 is disposed on the apparatus body. With this structure, as described in the above embodiments, compared to a state in which the biasing member such as the clip 150 is disposed to the detachably attachable unit such as the optical writing device, the cost rise in the apparatus can be prevented.

In addition, the present aspect 1 can be applied to any detachably attachable unit such as a process cartridge that is positioned relative to the apparatus body.

<Aspect 2> In Aspect 1, the pressing member such as the clip 150 includes a tool 160 and a jig 151, the tool 160 is hooked by the jig 151, and the pressing member is elastically deformed and rotated by the tool 160, so that the pressing member is contacted the contact part.

According to the aspect 2, compared to a case in which the member to rotate the pressing member is disposed at the apparatus body, the apparatus can be produced at a lower cost.

<Aspect 3> In Aspect 2, the detachably attachable unit such as the optical writing device 16 includes the first fixing part 87 that includes a supporting point 87E used for rotating the tool 160, that rotates the pressing member such as the clip 150 while elastically deforming it.

According to Aspect 3, as described in the above embodiments, when the pressing member such as the clip 150 is elastically deformed by the tool 160, for example, the tool can hold the detachably attachable unit not to move due to the resilience force of the pressing member. With this structure, the pressing member can be elastically deformed by the tool 160 and can be easily hooked by the contact part such as the fixing part 87, thereby improving the workability.

<Aspect 4> According to Aspect 3, a guiding part 87D to guide the tool 160 to the supporting point 87E is disposed.

According to Aspect 4, as described in the above embodiments, the leading end of the tool 160 can be inserted to the supporting point 87E easily, thereby improving workability.

<Aspect 5>A general-purpose screw driver is used as a tool in Aspects 2 to 4. According to Aspect 5, positioning of the optical writing device 16 relative to the apparatus body can be performed without using any special tool.

<Aspect 6> According to any of the above aspects, the pressing member such as the clip 150 is made of a metallic linear material.

According to Aspect 6, by folding back and molding the wire made of iron, the above-described elastic adjusters 150B and rising parts 150F can be easily formed in the desired shape, to thus construct the clip 150.

<Aspect 7> According to any of the above aspects, the detachably attachable unit is the optical writing device 16 to write a latent image on the surface of the latent image carrier such as the photoconductor.

<Aspect 8> The optical writing device 16 is appropriately positioned in the apparatus body inexpensively.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an apparatus body including positioning faces;

a detachably attachable unit configured to be attachable to and detachable from the apparatus body and including receiving parts and contact parts; and a biasing member to press the receiving parts of the detachably attachable unit to the positioning faces disposed on the apparatus body, wherein:

the biasing member is rotatably disposed to the apparatus body, contacts the contact parts disposed on the detachably attachable unit, presses the receiving parts against the positioning faces, and is elastically deformable in a direction separating from a rotary supporting point of the biasing member;

the biasing member is rotated to a release state, in which the detachably attachable unit is released from the apparatus body, and a locked state, in which the detachably attachable unit is secured to the apparatus body and the biasing member is elastically deformed at points thereof contacting the contact parts disposed on the detachably attachable unit; and when the biasing member is rotated to the locked state from the release state, the biasing member is hooked to the contact parts, and the receiving parts are pressed toward the positioning faces by the biasing member.

2. The image forming apparatus as claimed in claim 1, wherein the biasing member comprises a jig, wherein a tool is dimensioned to be hooked to the jig to rotate the biasing member while the biasing member is being elastically deformed so that the biasing member contacts the contact parts.

3. The image forming apparatus as claimed in claim 2, wherein the detachably attachable unit has a supporting point for the tool used for rotating the biasing member while elastically deforming the biasing member.

4. The image forming apparatus as claimed in claim 3, further comprising a guiding part to guide the tool to the supporting point.

5. The image forming apparatus as claimed in claim 2, wherein the tool is a general-purpose screw driver.

6. The image forming apparatus as claimed in claim 1, wherein the biasing member is metal wire.

7. The image forming apparatus as claimed in claim 1, further comprising:

a latent image carrier; and an optical writing device as the detachably attachable unit to write a latent image on a surface of the latent image carrier.

8. An image forming apparatus comprising:

an apparatus body including positioning faces;

a detachably attachable unit configured to be attachable to and detachable from the apparatus body and including receiving parts and contact parts; and a biasing member to press the receiving parts of the detachably attachable unit to the positioning faces disposed on the apparatus body, wherein:

the biasing member is rotatably disposed to the apparatus body, contacts the contact parts disposed on the detachably attachable unit, presses the receiving parts against the positioning faces, and is elastically deformable in a direction separating from a rotary supporting point of the biasing member;

the biasing member is rotated to a release state, in which the detachably attachable unit is released from the apparatus body, and a locked state, in which the detachably attachable unit is secured to the apparatus body;

when the biasing member is rotated to the locked state from the release state, the biasing member is hooked to the contact parts, and the receiving parts are pressed toward the positioning faces by the biasing member;

the biasing member comprises a jig; and a tool is dimensioned to be hooked to the jig to rotate the biasing member while the biasing member is being elastically deformed so that the biasing member contacts the contact parts.

* * * * *